United States Patent [19]

Powers

[11] 3,999,802

[45] Dec. 28, 1976

[54] CHAIR

[76] Inventor: George Pyrke Powers, 209 Dianne Ave., Oakville, Ontario, Canada

[22] Filed: Mar. 17, 1975

[21] Appl. No.: 558,790

[52] U.S. Cl. ..... 297/447; 297/218; 297/239; 297/295; 297/446; 297/448; 297/457

[51] Int. Cl.[2] ..... A47C 1/12

[58] Field of Search ... 297/294, 295, 218, 445–448, 297/239, 457

[56] References Cited

UNITED STATES PATENTS

| | | | |
|---|---|---|---|
| 2,565,870 | 8/1951 | McGuire | 297/295 |
| 2,722,967 | 11/1955 | Reinholz | 297/447 X |

*Primary Examiner*—James C. Mitchell
*Attorney, Agent, or Firm*—W. Charles Kent

[57] ABSTRACT

A chair having a unitary metal frame of the so-called runner type wherein there is along each side a runner joining the bottom of the front and rear legs of such respective side of the chair, the frame being fabricated from a length of metal rod, tube or the like, the opposite ends of the length of metal being welded or otherwise permanently secured. This continuous loop of metal is shaped to provide the chair frame comprising spaced apart sides of the back and seat, the front legs, runners, and rear legs respectively and also transverse connecting reaches between the top of the sides of the back and the top of the rear legs of the chair. Reinforcing cross-pieces join the spaced apart sides of the frame near the top of the front legs and in the area where the bottom of the back joins the rear of the seat, the latter cross-piece being in juxtaposed and initially spaced relation but releasably fastenable to the transverse connecting reach between the top of the rear legs to strengthen and rigidify the chair frame against sway and twist. While the open gap or passage between the juxtaposed and spaced cross-piece and reach is unobstructed, a replaceable upholstery sleeve with one open end is applied over the back of the chair frame, extended to the front of the seat and down over the front legs to the above first-mentioned frame-reinforcing cross-piece where a flap which may be provided along one edge of the open end of the sleeve can be passed under the adjacent frame-reinforcing cross-piece and secured as by a separable fastener to the opposite edge of the open end of the sleeve, then the juxtaposed cross-piece and reach are releasably fastened capturing the upholstery sleeve against displacement.

3 Claims, 6 Drawing Figures

CHAIR

BACKGROUND OF THE INVENTION

This invention relates to improvements in a chair and appertains particularly to one having a metal frame such as those fabricated of wire rod, metal tube and the like, suitable for stacking.

Metal frame stacking chairs come in a wide variety of designs, many being ugly, weak and flimsy, or heavy and bulky, calling for excessive material, unnecessary forming steps, requiring too many parts and reinforcements, being thereby rendered expensive to manufacture and clumsy to handle. Subsequent to the assembly of the frame, separate back and seat sections are often permanently applied adding to the weight and cost of the chair and necessitating premature discard of the item when the upholstery covering has worn out.

The need for a light-weight yet stable, sturdy and durable wire rod, runner type, stacking chair with a readily replaceable upholstery covering has thus far been unsatisfied due often to the presence of one or more of the aforementioned deficiencies.

SUMMARY OF THE INVENTION

It is an object of this invention to provide a light-weight runner type, metal frame chair having a replaceable upholstery sleeve.

It is a further object of the invention to provide a chair having a unitary, runner type, metal frame of novel design, over the back and seat parts of which a one-piece upholstery sleeve can be applied and removed as required.

A still further object of the invention is to provide a unitary metal frame for a chair of the nature and for the purpose described, that is accorded increased strength and stability of releasable fasteners joined juxtaposed frame parts.

To the accomplishment of these and related objects as shall become apparent as the description proceeds, the invention resides in the construction, combination and arrangement of parts as shall be hereinafter more fully described, illustrated in the accompanying drawings and pointed out in the claims hereunto appended.

BRIEF DESCRIPTION OF THE DRAWINGS

The invention will be best understood and can be more clearly described when reference is had to the drawings forming a part of this disclosure wherein like characters indicate like parts throughout the several views.

In the drawings.

DETAILED DESCRIPTION OF THE PREFERRED EMBODIMENT

Figure 1:
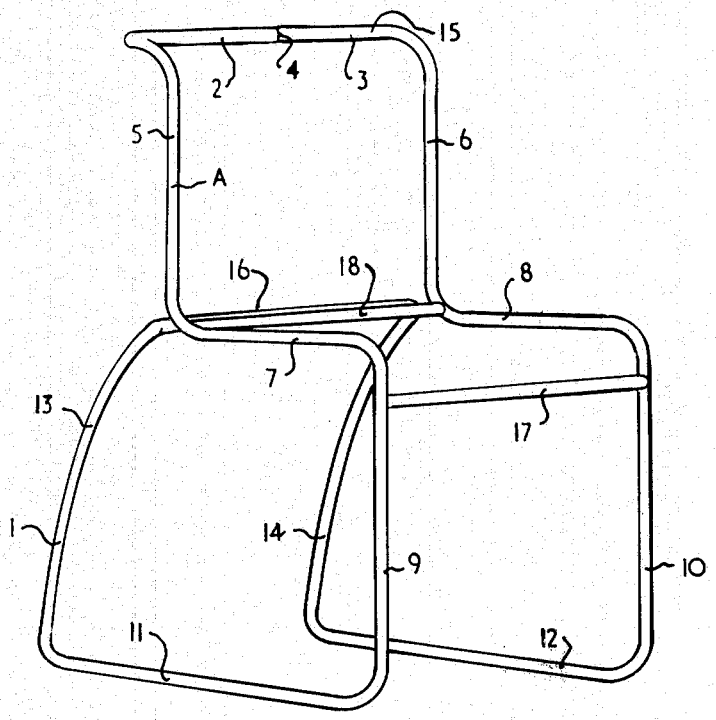
FIG. 1 is a front-side isometric view of the unitary, wire rod frame of the chair.
Figure 2:
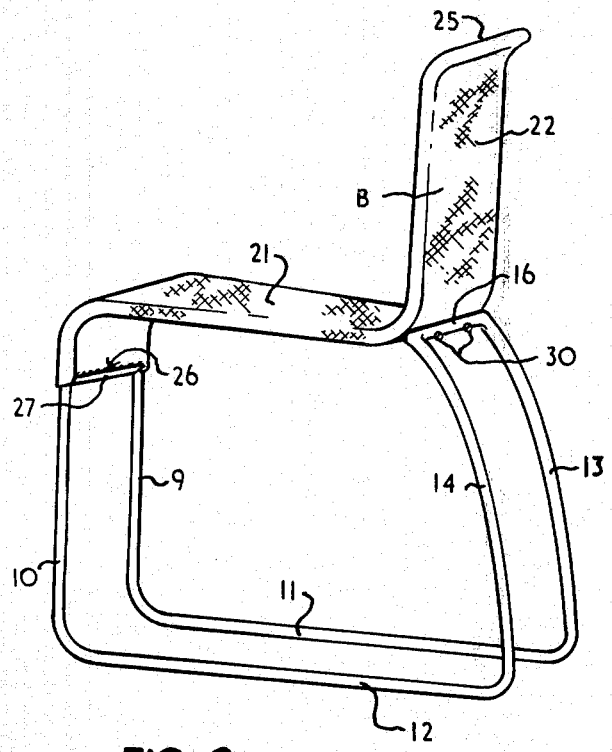
FIG. 2 is a rear-side isometric view of the chair, with the replaceable upholstery sleeve applied thereto.

To meet the modern demand for a metal stacking chair of the so-called runner type, this invention as shown in the attached drawings consists of a unitary metal frame and a replaceable upholstery sleeve captured thereon.

In the preferred embodiment illustrated, the frame A is fabricated from a single length of wire rod 1 whose opposite ends 2 and 3 are welded in abutting relation as at 4 to form a continuous loop. This continuous loop of metal is then shaped to provide a skeletal, unitary, chair frame as is clearly seen in FIG. 1 comprising parallel spaced apart sides 5 and 6 of the back, sides 7 and 8 of the seat, front legs 9 and 10, runners 11 and 12 and rear legs 13 and 14 respectively, together with a transverse connecting reach 15 between the top of the sides 5 and 6 of the back and a second transverse reach 16 between the top of the rear legs 13 and 14.

The chair frame in side elevation consists of approximately vertical sides 5–6 of the back from the bottom of which the sides 7–8 of the seat extend horizontally forwards with the front legs 9–10 depending vertically to the rearwardly extending runners 11–12 that are of greater length than the sides of the seat so that the rear legs 13–14 rising therefrom are inclined or arced forwardly from the vertical to locate the horizontal transverse reach 16 to the rear of but in close proximity to the area where the bottom of the back portion of the frame joins the rear of the seat portion of the frame.

A first reinforcing cross-piece 17 joins the spaced apart sides of the frame near the top of the front legs 9–10 and a second cross-piece 18 joins the spaced apart frame sides in the area where the sides 5–6 of the back join the sides 7–8 of the seat, said second cross-piece 18 being in juxtaposed and spaced relation to the second transverse reach 16 extending horizontally between the top of the rear legs 13–14. The juxtaposed transverse reach 16 and the cross-piece 18 are releasably connectible as will be further described.

Figure 3:
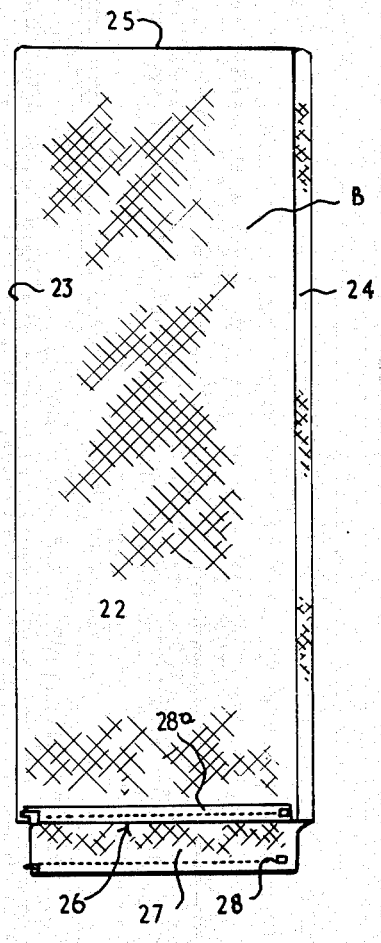
FIG. 3 is an enlarged view of the rear or underside of the upholstery sleeve.

To complete the chair, an upholstery unit in the form of a simple replaceable sleeve B is provided. It may be formed like a pillow slip as seen in FIG. 3 with a front 21, back 22, opposite sides 23–24, one closed end 25 and one open end 26. At the open end 26, the front side 21 of the sleeve is extended to constitute a flap 27 along that side of the opening having a slide fastener part 28 on its inner face for engagement with a companion fastener part 28$^a$ on the outer face of the opposite side of the open end.

This upholstery sleeve is applied to the skeletal frame by slipping its open end 26 down over the back of the frame and forward to the front of the seat and then part way down the front legs, the length of the sleeve being proportioned to allow the open end 26 to reach to or about the level of the reinforcing cross-piece 17, under which the flap 27 is passed and the fastener part 28 on its free edge is attached to the companion part 28$^a$ along the opposite side of the open end of the sleeve. The upholstery item may be padded or modified as desired without departing from its simple pull-on sleeve design with only a single open end.

Once the upholstery sleeve B is in place, the open gap or passageway between the connecting reach 16 and the rear of the frame A in the area where the chair back and seat meet may be closed by releasably securing the connecting reach 16 to the juxtaposed cross-piece 18 by the spaced pair of self-tapping screws 30 that pass through the back 22 of the upholstery and cause the same to be compressed between the reach and cross-piece and held against displacement thereby.

Figure 4:
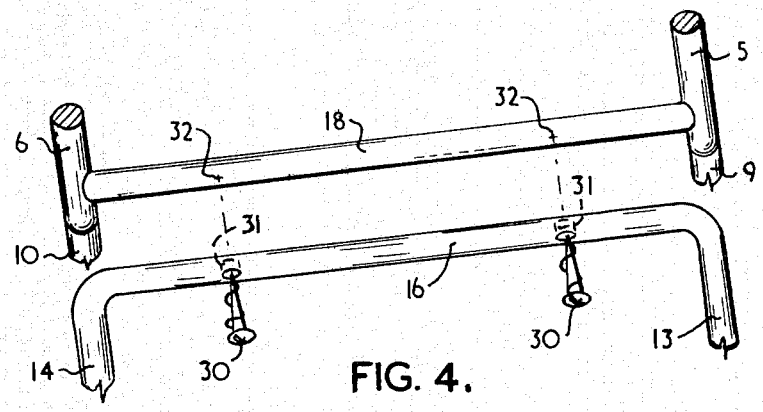
FIG. 4 is an enlarged exploded view of the reinforcing cross-piece at the rear of the seat and the juxtaposed connecting reach between the top of the back legs of the chair.

To facilitate the attachment of the reach 16 and cross-piece 18, see FIG. 4, the former may be drilled to provide screw accommmodating bores 31 and the cross-piece is appropriately punch marked as at 32 in registry therewith to give locating and starting points for the screws.

Figure 5:
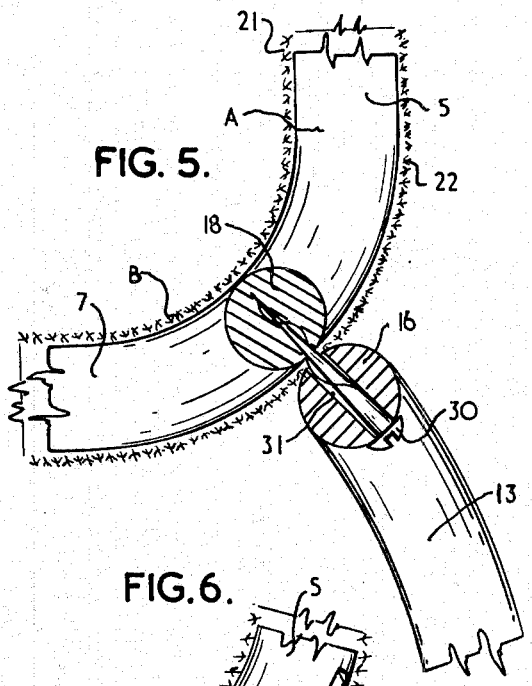
FIG. 5 is a further enlarged vertical section of the parts shown in FIG. 4, fastened together following application of the upholstery sleeve.
Figure 6:
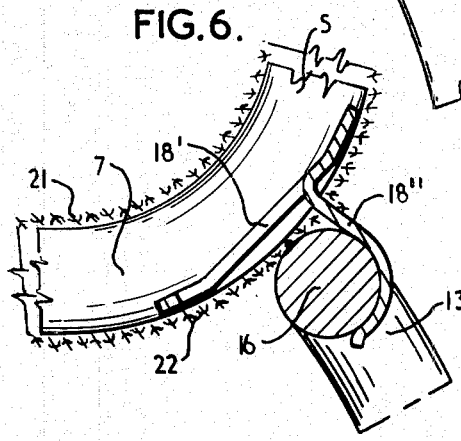
FIG. 6 is a similar sectional view of a modified form of frame-reinforcing cross-piece for releasable fastening with the juxtaposed connecting reach.

The reinforcing cross-pieces 17 and 18, where seen in FIGS. 1, 4 and 5, appear as bars of wire rod similar in cross-section to the material of the initial length of rod 1 fashioned into the endless loop that forms the frame. Such cross-pieces may be of any profile or cross-section shape desired. The modified structure shown in FIG. 6 employs a sheet metal cross-piece 18' of non-planar cross-section and secured at its ends as by welding to the spaced apart sides of the frame and located near the outer arc of the curve where the sides 5–6 of the frame back join the sides 7–8 of the seat. To such a formed metal cross-piece 18' the reach 16 could be secured by self-tapping screws as already mentioned but this modified cross-piece 18' is provided with a transversely spaced pair of integral downwardly extending clips 18'' struck laterally therefrom, such clips being of arcuate form to accommodate and retain reach 16 inside and under the arcuate hook of the clip when press-locked firmly therein and, like the connection already described, to hold the upholstery sleeve against displacement and to strengthen and rigidify the chair assembly and resist sway and twist of the frame.

In the manufacture of a metal frame stacking chair of the so-called runner type it has been found that the novel method of construction disclosed herein contributes significantly to (a) simplifying the assembly, (b) cutting labour time and costs, (c) saving material and (d) reducing the weight of the chair. These benefits are attained by forming the wire rod frame so that the sides of the back flow into the sides of the seat and on down the front legs without interruption and by providing a gap or passageway between the frame sides where the bottom of the back flows into the rear of the seat and the juxtaposed and spaced reach connecting the top of the rear legs. Such open gap allows the one-piece upholstery sleeve, with only one end open, to be applied without obstruction and rapidly secured by fastening the open end flap around the horizontal reinforcing cross-piece near the top of the front legs. Then the gap is closed by releasably attaching the rear leg reach to the chair frame greatly adding to the strength and rigidity of the chair.

It is understood that various changes in the size, shape and arrangement of parts may be made to the form of invention herein shown and described, without departing from the spirit of the invention or scope of the claims.

What is claimed is:

1. A chair suitable for stacking, of the so-called runner type, comprising a metal frame consisting of a length of material forming an unbroken loop and shaped to provide continuous transversely spaced opposite sides of the back and seat, spaced apart front legs, runners and rear legs of the chair in that sequence and to connect the top of the spaced sides of the back and the top of the rear legs by horizontal transverse reaches, and a replaceable upholstery sleeve providing the back and seat of the chair, said sleeve having one open end and applied by slipping the same down over the back of the frame and forwardly along the sides of the seat to the front of the frame, said metal frame having a first horizontal frame reinforcing cross piece joining the spaced apart sides of said frame in the area where the sides of the back join the sides of the seat, the horizontal transverse reach connecting the top of the rear legs, prior to application of said upholstery sleeve being in juxtaposed and spaced relation to said first reinforcing cross piece, affording free passage therebetween for application of the upholstery sleeve, said transverse reach connecting the top of the rear legs being secured to the frame in the area where the sides of the back join the sides of the seat to capture the upholstery sleeve application thereof and rigidify the chair frame.

2. A chair according to claim 1 further comprising means for releasably fastening the first reinforcing cross piece and the juxtaposed reach connecting the top of the rear legs, said transverse reach connecting the top of the rear legs being releasably fastened by said fastening means to the frame in the area where the sides of the back join the sides of the seat.

3. A chair according to claim 2, wherein said metal frame has a second frame reinforcing cross piece joining the spaced apart sides of the frame near the top of the front legs, and wherein said upholstery sleeve has a flap along one edge of its open end that is extendable under the second horizontal reinforcing cross piece near the top of the front legs and securable by a separable fastener to the opposite edge of said open end.

* * * * *